US006539888B1

(12) United States Patent
van der Poel

(10) Patent No.: US 6,539,888 B1
(45) Date of Patent: Apr. 1, 2003

(54) WORKING SHIP

(75) Inventor: Hans van der Poel, Rockanje (NL)

(73) Assignee: Buitendijk Holding B.V., Le Zwijndrecht (NL)

( * ) Notice: Subject to any disclaimer, the term of this patent is extended or adjusted under 35 U.S.C. 154(b) by 0 days.

(21) Appl. No.: 09/869,209

(22) PCT Filed: Dec. 23, 1999

(86) PCT No.: PCT/NL99/00798

§ 371 (c)(1),
(2), (4) Date: Sep. 24, 2001

(87) PCT Pub. No.: WO00/38977

PCT Pub. Date: Jul. 6, 2000

(30) Foreign Application Priority Data

Dec. 23, 1998 (NL) ..... 1010884

(51) Int. Cl.[7] ..... B63B 35/44; E02B 17/08
(52) U.S. Cl. ..... 114/265; 405/196
(58) Field of Search ..... 114/61.12, 61.15, 114/256, 257, 264, 265; 405/196, 203

(56) References Cited

U.S. PATENT DOCUMENTS

| | | | | | |
|---|---|---|---|---|---|
| 2,946,566 | A | * | 7/1960 | Samuelon | 114/265 |
| 3,001,370 | A | * | 9/1961 | Templeton | 114/265 |
| 3,294,051 | A | * | 12/1966 | Khelstovsky | 114/265 |
| 3,385,069 | A | * | 5/1968 | Estes | 114/61.14 |
| 3,433,024 | A | * | 3/1969 | Diamond et al. | 405/196 |
| 3,474,749 | A | * | 10/1969 | Williamson | 405/196 |
| 3,590,765 | A | * | 7/1971 | De Lizasoain | 114/275 |
| 3,685,305 | A | | 8/1972 | Lloyd, III | |
| 3,837,309 | A | | 9/1974 | Biewer | |
| 4,266,887 | A | * | 5/1981 | Corder | 405/196 |
| 4,692,081 | A | | 9/1987 | Bennett et al. | |
| 5,190,410 | A | * | 3/1993 | Nunley | 405/196 |
| 6,024,040 | A | * | 2/2000 | Thomas | 114/264 |

FOREIGN PATENT DOCUMENTS

| | | |
|---|---|---|
| FR | 1.366.164 | 10/1964 |
| FR | 2.229.816 | 12/1974 |
| GB | 2 085 814 | 6/1982 |
| GB | 2 150 516 | 3/1985 |

* cited by examiner

*Primary Examiner*—S. Joseph Morano
*Assistant Examiner*—Andy Wright
(74) *Attorney, Agent, or Firm*—Swanson & Bratschun, L.L.C.

(57) ABSTRACT

A working ship (1), comprising a hull (2) provided with driving means and a deck (3). The hull (2) is temporarily submersible. The deck (3) is connected to the hull by using connecting means (8) at an adjustable intermediate distance. The working ship (1) is thus adjustable between a floating position in which the deck (3) is located near the hull and a semi-submerged position in which the hull is located substantially below the water surface and the deck (3) is located above the water surface at a distance from the hull.

20 Claims, 5 Drawing Sheets

WORKING SHIP

RELATED APPLICATIONS

This application is a 35 U.S.C. § 371 national phase application of PCT/NL99/00798 (WO 00/38977) filed on Dec. 23, 1999, entitled "Working Ship," which claims priority to the Netherlands Application Number 1010884, filed Dec. 23, 1998.

The invention relates to a working ship for carrying out offshore operations, in particular for preparing and/or exploiting extracting sites of natural resources, such as oil and gas.

During the offshore extraction of natural resources, there is an increasing need for exploitation of extracting sites that are located relatively far away front the shore and/or at a relatively great depth. According to present insights, it is believed that about 65% of the oil supply to be extracted offshore is located in regions relatively far away from the shore where the sea floor is located at a depth of at least 2000 m.

When preparing and exploiting such extracting sites, preparation and exploitation operations have to be carried out on the extracting site. When preparing and exploiting an oil extracting site, these operations consist in, among other things, the steps of placing of a valve on the sea floor, providing a riser pipe construction between the valve and the sea surface, drilling the oil supply in the soil and making it ready for production, extracting oil from the soil, optionally storing and/or processing oil, and discharging the extracted oil.

Because of the relatively great distance from the shore and/or the relatively great depth of the sea floor, it has been found to be a problem to prepare and exploit such extracting sites economically. When the extracting site is located at a relatively great distance from the shore, for instance stores and personnel can be transported by air only to a very limited extent. Consequently, stores and personnel have to be transported relatively fast over the sea to the working site, and on the working site sufficient storage capacity has to be available. When the working site is located at a relatively great depth, it is not possible to provide on the working site a working platform supported by the sea floor.

It has already been proposed that operations for preparing and exploiting such extracting sites be carried out by using a so-called "semi-submersible". Such a construction comprises a rectangular deck placed on legs. The legs are connected by using floats located below the water surface. Such a semi-submersible is adjustable by varying the floating power of the floats between a floating position in which the deck is located at a relatively great distance from the water surface and a semi-submerged position in which the deck is located relatively close to the water surface. In the floating position, the semi-submersible is transported to the extracting site to subsequently function, in the semi-submerged position, as working platform. It is a disadvantage of such a semi-submersible that it cannot sail independently to a faraway working site but has to be towed to the extracting site by a tugboat. Furthermore, the sailing speed of such a construction is limited so that transport to such a faraway extracting site takes too long. Moreover, the center of gravity of such a construction is located relatively high so that even if few stores are carried along on the deck there is a risk of capsizing. The risk of capsizing is even increased during the adjustment from the floating position to the semi-submerged position.

U.S. Pat. No. 3,837,309 describes a semi-submersible construction having the features of the preamble of claim 1.

The construction is capable of being moved under its own power and has a block-shaped, rectangular hull.

FR 1 366 164 describes a semi-submersible having a block-shaped storage tank that, during transport, is used as a hull.

It has also been proposed that the preparation and exploitation of such extracting sites which are far away and/or located at a great depth be carried out by using a working ship with a conventional hull provided with driving means. Such a ship having an elongate hull is described in GB 2 150 516. It is a disadvantage of such a ship that when lying still on the extracting site it follows wave motions of the water surface too much. Consequently, the deck is often not stable enough to carry out the preparing or exploiting operations. This leads to a greatly decreased productivity.

It is an object of the invention to provide a ship that does not have the above disadvantages. To this end, a working ship according to the invention comprises a hull provided with driving means and a deck, which hull is temporarily submersible, and which deck is adjustably connected at an adjustable intermediate distance to the hull by connecting means so that the working ship is adjustable between a floating position in which the deck is located near the hull and a semi-submerged position in which the hull is located substantially below the water surface and the deck is located above the water surface at a distance from the hull.

Preferably, the hull is of elongate shape, having a length to width ratio of more than 3:1. More preferably the hull has a length to width ratio ranging from approximately 4:1 to 5:1. Such a hull of elongate shape provides for a high sailing speed at relatively low engine power and fuel consumption. Surprisingly it has been found that, both in the floating position and in the working position, the elongate hull provides for ample stability. Due to its elongate shape, the longitudinal hull can be positioned with its longitudinal axis substantially transverse to the waves and/or substantially parallel to the wind. This greatly improves operating conditions in the submerged or floating position compared to a waking vessel with a substantially square hull, having a length to width ratio of approximately 1:1. Also, during transition from the floating position to the submerged position, such positioning can improve stability.

The effect thus achieved is that in the floating position the working ship can sail to the extracting site independently, without a risk of capsizing, fast, and provided with sufficient stores, while in the semi-submerged position it is sufficiently stable on the extracting site. In the semi-submerged position, the surface of the working ship located near the water surface is relatively small, while a great part of the total weight of the working ship is located below the water surface. Consequently, the deck, even when much wind and/or high waves are present, will be sufficiently stable to enable the operations to be carried out. To increase the stability, the hull, in the semi-submerged condition, can comprise more than 50%, preferably more than 60% of the total weight of the working ship. For an optimum stability, the center of gravity of the working ship in the semi-submerged condition is located near or below the water surface.

It is observed that when in this context reference is made to a hull, this is a single hull, that is to say a hull forming one floating body. It is further observed that the working ship can also be used on sites other than extracting sites, for instance to lay pipelines on the sea floor. Consequently, reference will hereinafter be made to the working site of the working ship.

Further elaborations of advantageous embodiments of the working ship are described in the subclaims.

The invention will be explained in more detail with reference to an exemplary embodiment shown in a drawing. In the drawing.

It is observed that the figures are only diagrammatic representations of a preferred embodiment of a working ship according to the invention. In the figures similar or corresponding parts are indicated with the same reference numerals.

Figure 1:
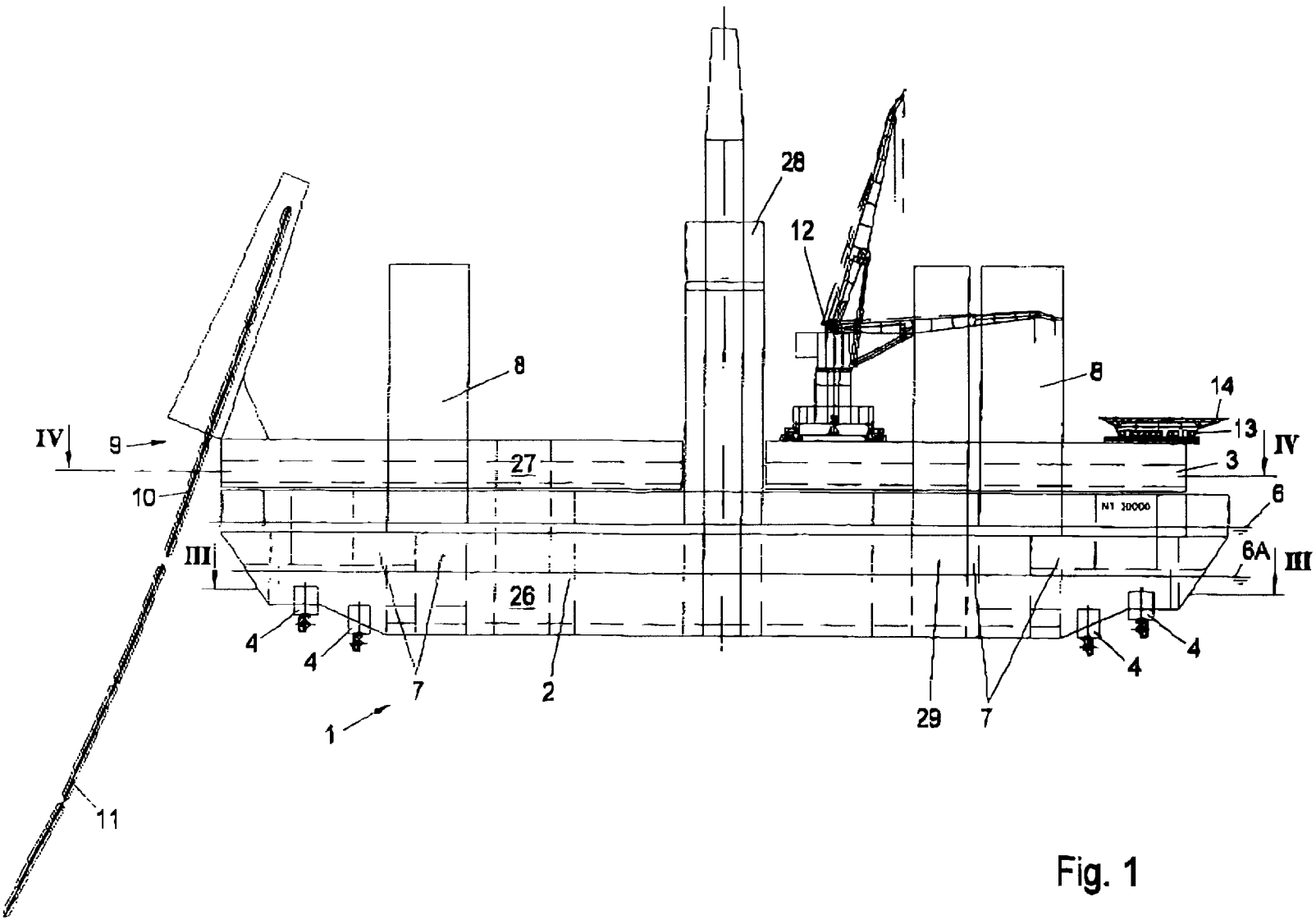
FIG. 1 is a diagrammatic side view of a working ship according to the invention in the floating position.

FIG. 1 shows a working ship 1 in a floating position. In the floating position or "transport position", the ship can sail over the sea to a working site. The working ship 1 comprises a hull 2 and a deck 3. The hull 2 forms a single floating body and is temporarily submersible. The hull 2 is provided with driving means 4 and has a streamlined hull form which at least partly corresponds to the hull form of conventional seagoing ships so that in connection with the great distance to be travelled the working ship can sail sufficiently fast in the transport position, for instance at a speed of at least 15 knots.

Figure 2:
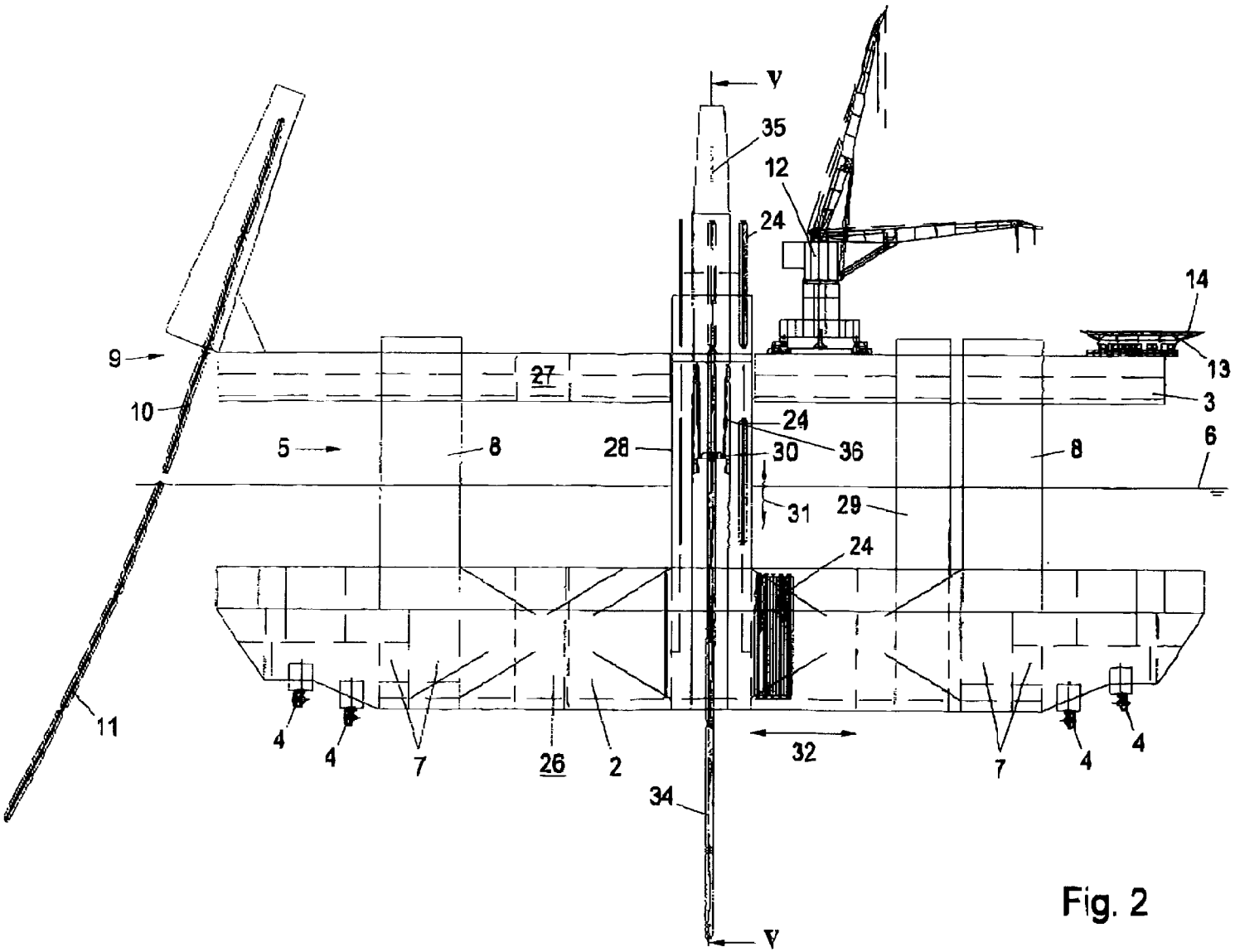
FIG. 2 is a diagrammatic side view of a working whip according to the invention in the semi-submerged position.

The deck 3 is connected with the hull 2 by using connecting means 5 at an adjustable intermediate distance. The working ship 1 is adjustable between the floating position shown in FIG. 1 in which the deck 3 is situated near the hull 2 and a semi-submerged position shown in FIG. 2. Referring to FIG. 2, the deck 3 is situated at a distance from the hull 2 and the hull 2 is situated substantially below the water surface 6. When the working ship 1 has arrived on the working site, the working ship is adjusted from the transport position to the semi-submerged or "working" position. The adjustment is carried out by reducing the floating power of the hull 2. This can advantageously be done by providing the hull with ballast tanks 7 and with control means for controlling the amount of ballast stored in the ballast tanks. Furthermore, the intermediate distance between the deck 3 and the hull 2 is adjusted to a greater value by using connecting means 5 so that the deck 3 is located above the water surface 6 at a distance from the hull 2.

The connecting means 5 are designed as legs 8 which are rigidly connected to the hull 2, while the deck 3 is provided with hoisting or lifting means to enable distance adjustment of the deck 2 relative to the hull 2 along the legs 8. The effect thus achieved is that, on the one hand, the connection between the hull 2 and the legs 8 can be simply and reliably made watertight, while, on the other hand, the adjustment of the intermediate distance between the hull 2 and the deck 3 can be effected by using conventional hoisting or lifting means as used in the offshore industry, for instance to enable a working deck of a drilling platform to be moved along the legs. Preferably, four legs 8 are used, the legs 8 being provided with racks, and the deck 3 being provided with pinions near the legs 8. It is of course also possible to use more or fewer legs 8. It is observed that it is of course also possible to construct the connecting means differently, for instance as legs 8 which are rigidly connected to the deck 3 and can be moved along the hull 2.

The working ship 1 can be positioned on the working site by using a dynamic positioning device, for instance four or eight independently driven screws disposed crosswise relative to each other. In less deep water, the working ship 1 can of course also be anchored on the working site by means of ground anchors. Depending on the operations to be carried out by the working ship 1, the deck 3 may be provided with different types of installations. Thus, for instance, the deck may be provided with a pipelaying device 9 for laying a pipeline 11 built up from pipe segments 10 over the sea floor. In such a cage, the working ship 1 will in the working position move slowly during the laying of the pipeline 10. A store of pipe segments 10 may then be kept in the hull 2 in a manner described hereinafter.

Furthermore, the working ship 1 can be used as crane ship. In such a case, a crane 12 or a lifting device of another type may be provided on a deck 3 to carry out hoisting or lifting operations. It is observed that such a lifting device may also be used to lift the deck 3 relative to the legs 8 or to carry out the deck 3 or to carry out pile driving operations at sea.

The working ship 1 will hereinafter be described in more detail in a use as offshore working ship for preparing and exploiting an oil extracting site.

Figure 4:
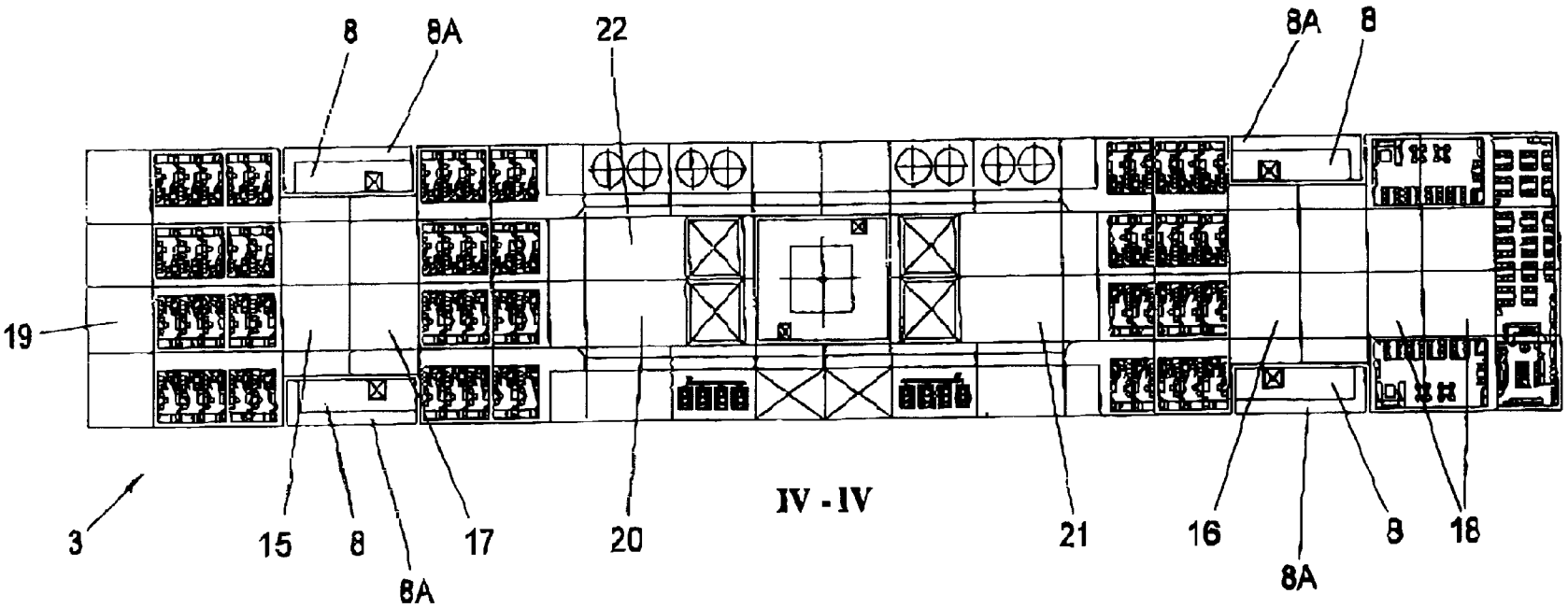
FIG. 4 is a diagrammatic top plan view of the working ship of FIG. 1, taken on the line IV—IV.

From a harbor, the working ship 1 sails independently in the transport position shown in FIG. 1 to an oil extracting site located at a great distance from a harbor, which site has to be prepared for exploitation and then has to be exploited. For the purpose of navigation, the deck 3 of the working ship 1 is provided with a bridge 13. The roof of the bridge 13 is advantageously arranged to be a helicopter landing site 14. Referring to FIG. 4, the deck 3 comprises a number of levels containing working spaces and sleeping apartments for persons, such as changing rooms 15, sleeping rooms 16, recreation rooms 17, dry and cooled storerooms 18, washrooms 19, pumping rooms 20, generator rooms 21, laboratories 22, etc. In the transport position, the amount of ballast stored in the ballast tanks 7 is relatively small so that the hull 2 has so much floating power that it is located at least partly above the water surface 6.

Figure 3:
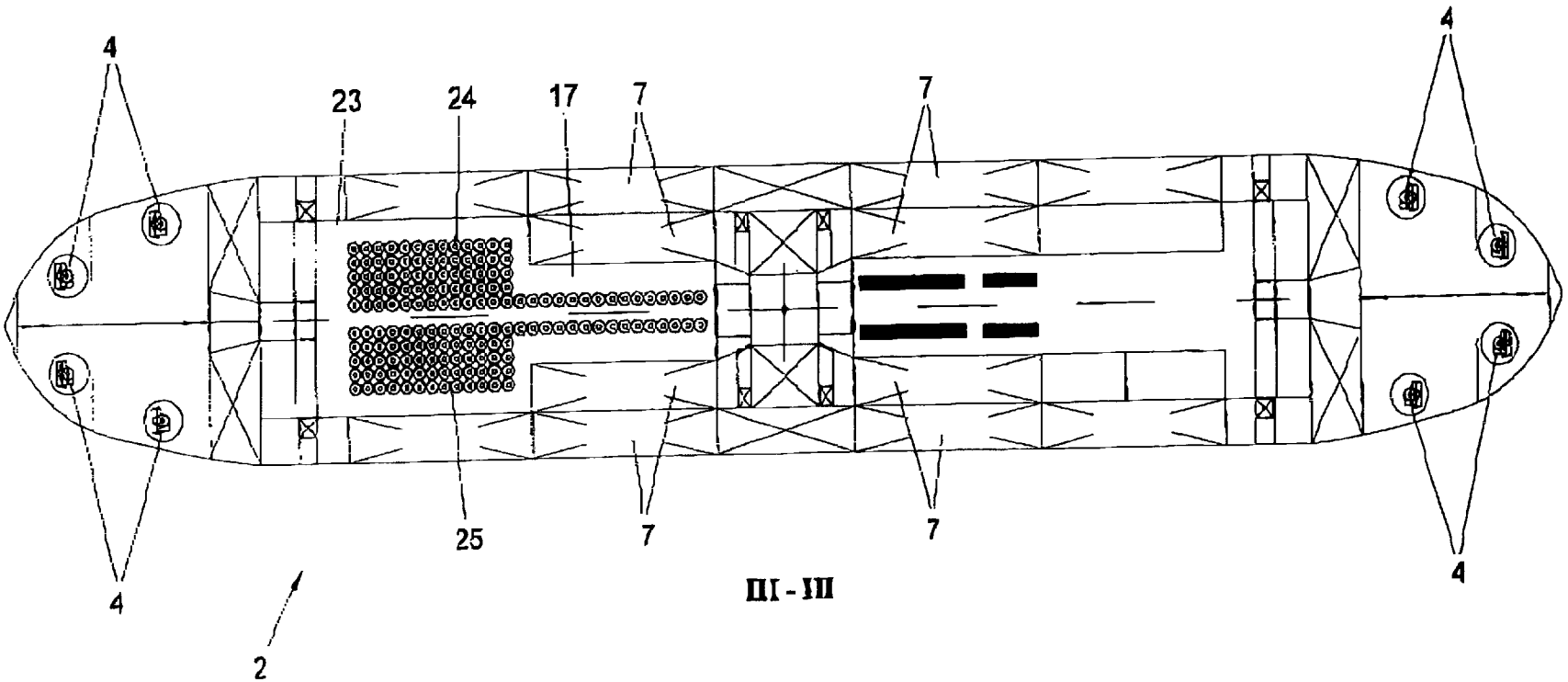
FIG. 3 is a diagrammatic top plan view of the working ship of FIG. 1, taken on the line III—III.

The hull 2 comprises storage rooms for keeping stores, such as water, fuel, spare parts, and other production aids (FIG. 3). By making the legs 8 hollow, it is achieved that the interior of the hull 2 is accessible, for instance for loading the interior of the hull 2. In FIG. 3 it is also visible that the legs 8 comprise a double-walled collision zone 8A.

Advantageously, the hull 2 comprises at least one storage space 23 for vertically storing pipe segments, such as riser pipe segments 24 and/or drilling pipe segments 25. By storing such pipe segments in the hull, the center of gravity of the working ship can be lowered so as to minimize the risk of capsizing. Consequently, the working ship 1, in particular in the transport position, is much more stable than a semi-submersible. By storing riser pipe or drilling pipe segments 24, 25 in the vertical position, it is achieved that these segments, apart from being efficiently stored, can also be readily introduced into the interior of the hull 2 and removed therefrom. This will hereinafter be explained in more detail.

When the width of the working ship 1 is chosen smaller than 31.5 m and the amount of ballast in the ballast tank 7 in adjusted by the control means so that the hull 2 will be temporarily located relatively far above the water surface, it can be achieved that, if desired, the working ship can make use of the Panama Canal to reduce the itinerary to the working site. This is shown in FIG. 1 by a water line 6A.

Once arrived on the working site, the ballast tanks 7 are filled with ballast, for instance water, and the hull 2 is submerged to below the water surface 6 (FIG. 2). Furthermore, the deck 3 is moved up along the legs 8 by using lifting means not shown in the figure so that the deck 3 is located above the water surface 6 at a distance from the hull 2. In this working position, the deck 3 is sufficiently stable for carrying out operations thereon.

To prepare the extracting site for production, a valve block is lowered by using a crane 12 from the deck 3 onto the sea floor. To facilitate this, the hull 2 comprises a channel 26 extending substantially vertically through the hull 2 and an opening 27 in the deck 3, corresponding with the channel 26, so that the water is accessible from the deck 3 via the opening 27 and the channel 26. Via the opening 27 and the channel 26, other objects, such as robots, can of course also be lowered into the water. Furthermore, other operations can be carried out via the opening 27 and the channel 26, for instance pile driving operations to fix a valve onto the sea floor. To disturb the streamline of the hull 2 as less as possible, the channel 27 can be provided with a closure near the bottom of the hull 2. Of course, it can also be advantageous to close the channel 26 and/or the opening 27 in other places, for instance for safety purposes.

Figure 5:
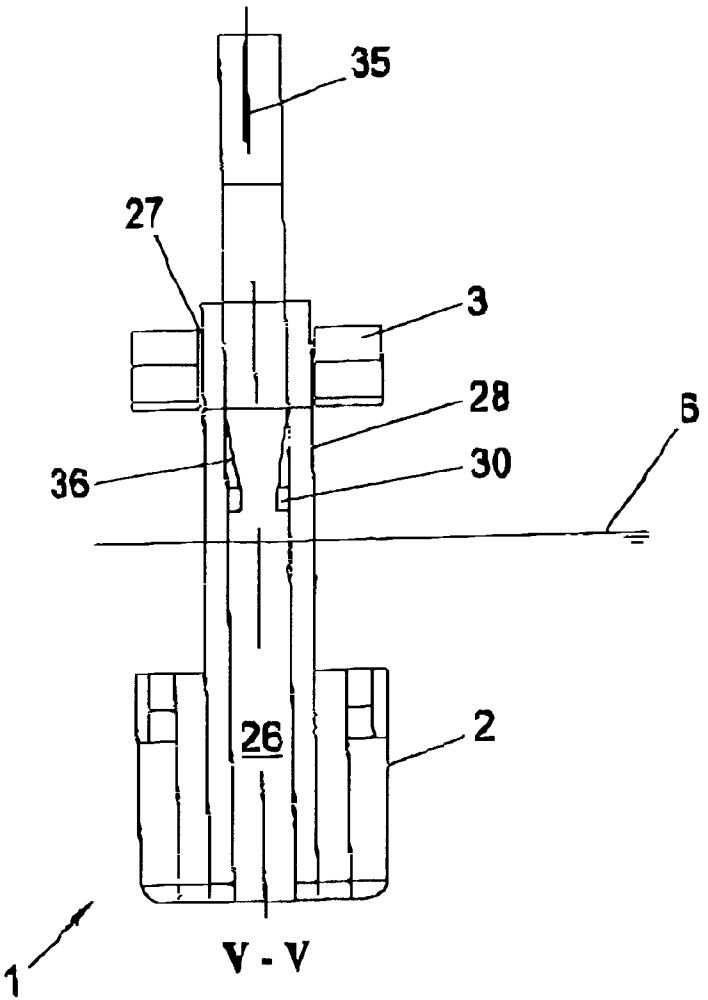
FIG. 5 is a diagrammatic cross-section of the working ship of FIG. 2, taken on the line V—V, while omitting a number of details.

Referring to FIG. 1, FIG. 2, and FIG. 5, the working ship 1 further comprises a substantially vertically disposed working column 28 for processing riser pipe or drilling pipe constructions or other offshore installations. In the embodiment shown, there is provided a central working column 28 having a channel 26 extending therein. The working column 28 also extends through the opening 27 in the deck 3 (FIG. 5). The working column 28 comprises a suspension device 30 for suspending a riser pipe or drilling pipe construction. In the semi-submerged condition of the working ship 1, the interior of the hull 2 is accessible via the hollow legs 8 and the working column 28.

The advantage of providing the working column 28 with an integrated channel 26 is that a shielded environment is created that provides both access to the hull and the water. In particular, the effect of wind and waves while hoisting and lowering objects from and into the water can be minimised by providing the shielded environment.

After a valve has been placed on the sea floor, riser pipe segments 24 are transported from the hull 2 via the working column 28 to the deck 3. To this end, the working ship 1 comprises vertical transport means 31 for moving riser pipe segments 24 vertically up and down via the interior of the legs 8 or the working column 28. Disposed in the hull 2 are moving means 32 for subsequently moving the riser pipe segments 24 vertically sidewards (FIG. 2). When building up a riser pipe construction, the riser pipe segments 24 are first transported from their storage space 23 to the working column 28 by using the horizontal moving means 32 and subsequently moved up vertically to the height of the deck 3 by using vertical moving means 31. Then the riser pipe segment 24 is placed above the channel 26, for instance by using a crane 12 or further horizontal moving means, and attached to the suspension device 30. In the working column with integrated channel, the riser pipes need in essence only be moved up and down and need not be reoriented. Then a next riser pipe segment 24 is supplied in the same manner and coupled to the preceding riser pipe segment 24. Each time when a riser pipe segment 24 has been coupled, the suspension device 30 is coupled off and the riser pipe 34 formed by the coupled riser pipe segments 24 is lowered by using hoisting means 35 and gripped again by using the suspension device 30. As soon as the riser pipe 34 has reached the sea floor, it is coupled to the valve. During the operations, possible movements of the working ship 1 relative to the riser pipe 34 are compensated by using the spacer means axially movable within the channel 26, such as hydraulic telescopic cylinders 36.

To enable the drilling of the oil well, drilling pipe segments 25 can be supplied in the same manner as the riser pipe segments 24. The further preparation of the extracting site for production in not explained in more detail, since it will be clear to those skilled in the art. It is observed, however, that by carrying out the process described in reverse order the riser pipe and drilling pipe segments 24, 25 can be brought back into the hull 2.

As soon as the oil well is ready for production, oil is supplied via the riser pipe 34 and, optionally after a first process step, discharged via a pipeline 11 to the shore or to a storage ship. The hull 2 may also comprise one or more storage tanks for storing oil extracted by using the working ship (FIG. 3). If the storage tanks are made sufficiently large, the working ship can also function as so-called FPSO or storage ship. During the filling of the storage tank, the amount of ballast stored in the ballast tanks 7, of course, has to be controlled by using the control means so as to maintain the correct floating power of the hull 2. It is observed that the working column 28 may also be disposed eccentrically on the ship.

Also provided is an auxiliary working column 29. In such an auxiliary working column 29, parts of riser pipe or drilling pipe constructions can be built up simultaneously in an analogous manner as described before and then be lowered into the water via the working column 28 or via a channel 26 disposed in the auxiliary working column 29. This enables not only a more rapid building up of a riser pipe or drilling pipe construction but also the normal continuation of the composition during heavy weather when the riser pipe construction has to be coupled off the working ship 1. Of course, such an auxiliary working column can also be used when dismantling constructions.

Furthermore, the interior of at least one of the legs or working columns may advantageously be provided with means for passing a winch rope of a ground anchor and with means for storing an anchor cable. It is thus achieved that a great length of winch ropes and anchor cables can be stored efficiently.

It is observed that the constructional parts of the working ship are not described in more detail, since they will be clear to those skilled in the art.

It is further observed that the invention is not limited to the exemplary embodiment shown herein. Many variations thereof are possible within the scope of the following claims.

What is claimed is:

1. A working ship for transport on a water surface and carrying out of off-shore operations at a working site on a water surface, the working ship comprising a single hull and a deck, said hull forming a floating body and being provided with driving means, said deck being located at all times during transport and at a working site above the water surface, said hull being temporarily submersible during off-shore operations, and said deck being connected to the hull by using connecting means at an adjustable intermediate distance so that the working ship is adjustable between a floating position in which the deck is located above the water surface and near the hull and a semi-submerged position in which the hull is located substantially below the water surface and the deck is located above the water surface at a distance from the hull, wherein the hull is of elongate shape, having a length to width ratio of more than 3:1.

2. The working ship according to claim 1, wherein the hull has a length to width ratio ranging from approximately 4:1 to 5:1.

3. The working ship according to claim 1, wherein the connecting means comprise legs which are rigidly connected to the hull, and wherein the deck is provided with hoisting or lifting means to enable distance adjustment of the deck relative to the hull along the legs.

4. The working ship according to claim 1, wherein in the semi-submerged condition the hull comprises more than 50%, of the total weight of the working ship.

5. The working ship of claim 4 wherien the semi-submerged condition of the hull comprises more than 60% of the total weight of the working ship.

6. The working ship according claim 1, wherein in the semi-submerged condition the center of gravity of the working ship is located near or below the water surface.

7. The working ship according to claim 1, wherein the hull comprises at least one ballast tank and control means for controlling an amount of ballast stored in the ballast tank.

8. The working ship according to claim 1, wherein the hull comprises at least one storage tank for storing raw material extracted by using the working ship, said storage tank further comprising supply and discharge means for supplying the extracted raw material to the storage tank and discharging it therefrom.

9. The working ship according to claim 1, wherein the hull comprises at least one storage space for vertically storing riser pipe segments, drilling pipe segments or both.

10. The working ship according to claim 1, wherein there is provided at least one substantially vertically disposed working column for processing riser pipe, drilling pipe constructions or other offshore installations.

11. The working ship according to claim 10, wherein the at least one working column comprises a suspension device for suspending a riser pipe or drilling pipe construction.

12. The working ship according to claim 11, wherein the hull comprises a channel extending substantially vertically through the hull and an opening in the deck, corresponding with the channel, so that the water is accessible from the deck via the opening and the channel, the channel extending within the working column.

13. The working ship according to claim 10, wherein an interior of the hull, at least in semi-submerged condition of the working ship, is accessible via an interior of the connecting means, the working column or both.

14. The working ship according to claim 13, wherein there are provided vertical transport means for moving riser pipe and/or drilling pipe segments vertically up and down via the interior of the connecting means and/or the working column, and wherein horizontal moving means are provided in the hull for moving the riser pipe and/or, drilling pipe segments horizontally.

15. The working ship according to claim 10, wherein the interior of at least one of the connecting means and/or working columns is provided with means for passing a winch rope, means for storing an anchor cable or both.

16. The working ship according to claim 10 further comprising the hull having a channel extending substantially vertically through the hull and an opening in the deck, corresponding with the channel, so that the water is accessible from the deck via the opening and the channel and a suspension device for suspending a riser pipe or a drilling pipe construction, the suspension device being operatively associated with at least one of the channel and the at least one working column.

17. The working ship according to claim 1, wherein the hull comprises a channel extending substantially vertically through the hull and an opening in the deck, corresponding with the channel, so that the water is accessible from the deck via the opening and the channel.

18. The working ship according to claim 17, wherein the channel is closable at least near the bottom of the hull.

19. The working ship according to claim 1, wherein there is provided a hoisting, pile-driving device or both.

20. The working ship according to claim 1, wherein there is provided a pipelaying device.

* * * * *